US007286096B2

(12) United States Patent
Jaffer et al.

(10) Patent No.: US 7,286,096 B2
(45) Date of Patent: Oct. 23, 2007

(54) ALIGNED DUPLEX ANTENNAE WITH HIGH ISOLATION

(75) Inventors: Aubrey Jaffer, Bedford, MA (US); John Fortier, Rochester, NY (US)

(73) Assignee: RadioLink Networks, Inc., Framingham, MA (US)

( * ) Notice: Subject to any disclaimer, the term of this patent is extended or adjusted under 35 U.S.C. 154(b) by 0 days.

(21) Appl. No.: 11/389,871

(22) Filed: Mar. 27, 2006

(65) Prior Publication Data

US 2007/0057860 A1 Mar. 15, 2007

Related U.S. Application Data

(60) Provisional application No. 60/665,888, filed on Mar. 28, 2005.

(51) Int. Cl.
*H01Q 13/00* (2006.01)

(52) U.S. Cl. ..... 343/779; 343/781 P

(58) Field of Classification Search ..... 343/779, 343/781 P, 840, 912

See application file for complete search history.

(56) References Cited

U.S. PATENT DOCUMENTS

| | | | |
|---|---|---|---|
| 3,739,392 | A | 6/1973 | Ross et al. |
| 3,898,667 | A | 8/1975 | Raab et al. |
| 3,914,768 | A | 10/1975 | Ohm |
| 4,095,230 | A | 6/1978 | Salmond et al. |
| 4,149,169 | A | 4/1979 | Weber |
| 4,246,586 | A | 1/1981 | Henderson et al. |
| 4,263,599 | A | 4/1981 | Bielli et al. |
| 4,270,128 | A | 5/1981 | Drewett |
| D272,910 | S | 3/1984 | Taggart et al. |
| 4,482,897 | A | 11/1984 | Dragone et al. |
| 4,542,532 | A | 9/1985 | McQuilkin |
| 4,612,552 | A | 9/1986 | Hovland et al. |
| 4,823,143 | A | 4/1989 | Bockrath |
| 4,841,305 | A | 6/1989 | Rose |
| 5,134,413 | A | 7/1992 | Bruder |
| 5,319,379 | A | 6/1994 | Waken et al. |
| 5,351,060 | A | 9/1994 | Bayne |
| 5,673,056 | A | 9/1997 | Ramanujam et al. |
| 5,691,734 | A | 11/1997 | Davies |
| 5,790,077 | A | 8/1998 | Luh et al. |
| 5,859,619 | A | 1/1999 | Wu et al. |
| 5,861,840 | A | 1/1999 | Tarran |

(Continued)

FOREIGN PATENT DOCUMENTS

| | | |
|---|---|---|
| JP | 2001185922 | 7/2001 |

OTHER PUBLICATIONS

Dicker et al., A two-element horn-reflector antenna for cosmic microwave background astronomy, IEEE Transactions on Antennas and Propagation, vol. 50, No. 2, Feb. 2002, pp. 198-204.

*Primary Examiner*—Hoang V. Nguyen
(74) *Attorney, Agent, or Firm*—Wilmer Cutler Pickering Hale and Dorr LLP

(57) ABSTRACT

Integrating dual antennae into a single rigid assembly guarantees parallel alignment between the antennae and provides higher isolation with lower insertion loss than duplexing methods can achieve through a single antenna. The resulting higher performance at lower cost can benefit two-way communication systems using time division duplexing, frequency division duplexing, or polarization division duplexing; or combinations of these methods.

20 Claims, 13 Drawing Sheets

U.S. PATENT DOCUMENTS 5,892,483 A 4/1999 Hayes et al.
5,923,292 A 7/1999 Dodd
5,936,580 A 8/1999 Van Puijenbroek
5,949,377 A 9/1999 Matsumoto et al.
5,963,170 A 10/1999 Garner et al.
5,977,926 A * 11/1999 Gilger ..... 343/781 P
5,995,057 A 11/1999 Faith et al.
5,995,065 A 11/1999 Kitchener et al.
5,995,882 A 11/1999 Patterson et al.
6,005,531 A 12/1999 Cassen et al.
6,031,504 A 2/2000 McEwan
D423,512 S 4/2000 Tsai
6,052,095 A 4/2000 Ramanujam et al.
6,054,953 A 4/2000 Lindmark
6,054,959 A 4/2000 Amos et al.
6,087,998 A 7/2000 Nguyen et al.
6,169,522 B1 1/2001 Ma et al.
6,191,747 B1 2/2001 Cosenza
6,201,511 B1 3/2001 Xue
6,211,835 B1 4/2001 Peebles et al.
6,288,620 B1 9/2001 Atokawa et al.
6,295,028 B1 9/2001 Jonsson et al.
6,308,051 B1 10/2001 Atokawa
6,313,713 B1 11/2001 Ho et al.
6,320,548 B1 11/2001 Harrell et al.
6,320,549 B1 11/2001 Nybeck et al.
6,320,553 B1 11/2001 Ergene
6,329,954 B1 12/2001 Fuchs et al.
6,396,441 B2 5/2002 Perrott et al.
6,404,392 B1 6/2002 Blom
6,417,809 B1 7/2002 Kadambi et al.
6,420,944 B1 7/2002 Costa et al.
6,441,794 B1 8/2002 Tang et al.
6,442,374 B1 8/2002 Brady et al.
D462,948 S 9/2002 Wilson
6,496,152 B2 12/2002 Nilsson
6,501,428 B1 12/2002 Blom et al.
D468,731 S 1/2003 Wilson
6,504,514 B1 1/2003 Toland et al.
6,522,868 B1 2/2003 Stilwell
6,597,324 B2 7/2003 Eriksson
6,603,437 B2 8/2003 Chang
6,608,600 B2 8/2003 Eriksson
6,608,602 B2 8/2003 Waltho et al.
6,639,568 B1 10/2003 Hartmann
6,691,779 B1 2/2004 Sezginer et al.
6,697,019 B1 2/2004 Hyuk-Joon et al.
6,697,643 B1 2/2004 Hagerman et al.
6,707,431 B2 3/2004 Byun et al.
6,750,821 B2 6/2004 Fang et al.
6,759,993 B2 7/2004 Judasz et al.
6,765,537 B1 7/2004 Apostolos
6,781,555 B2 8/2004 Ramanujam et al.
6,784,759 B2 8/2004 Maekawa et al.
6,819,874 B2 11/2004 Cheng et al.
6,836,258 B2 12/2004 Best et al.
6,859,182 B2 2/2005 Horii
6,862,439 B2 3/2005 Feng

* cited by examiner

Horn Assembly Casting

ALIGNED DUPLEX ANTENNAE WITH HIGH ISOLATION

CROSS-REFERENCE TO RELATED APPLICATIONS

This application is a non-provisional application claiming the benefit of provisional application No. 60/665,888, filed Mar. 28, 2005, entitled "Aligned Duplex Antennae with High Isolation".

Related subject matter is also disclosed in U.S. provisional patent application 60/637,645, filed Dec. 20, 2004, entitled "High Definition Television Distribution Over Wireless Metropolitan Area Networks".

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

TERMINOLOGY

By "duplex" is meant a channel which can carry information in both directions.

By "diplexer" is meant a device that separates or combines the radio frequency energy in two or more exclusive frequency bands to a single port.

By "radome" is meant an antenna cover made of material transparent to microwave radiation.

BACKGROUND OF THE INVENTION

This invention relates to the use of microwave antennae for duplex communications and radar.

Duplex communications (reception and transmission) through a single antenna requires separation of the transmitted and received signals, both for the protection of the sensitive receiver circuitry, and to prevent the transmissions from interfering with reception in (simultaneous) full-duplex applications.

When the duplex transmissions are sufficiently different in wavelength, diplexing or filtering can provide ports, each of which couple energy of primarily one channel. The degree to which power of the one wavelength is prevented from coupling to the port that is primarily for a different wavelength is termed its isolation.

Polarization can be used to separate receive and transmit signals.

In time division duplexing cases, where transmission and reception are not simultaneous, switchable attenuation can be provided between the receiver and the antenna.

Combinations of these methods can be used. For instance, separation in frequency and polarization can be employed where a single method is incapable of the desired isolation.

Otherwise, two antennae must be used for duplex operation, in which case both antennae must be aligned with the distant terminus of communication. Whereas an antenna connected to a receiver can be aligned by monitoring the received signal level, antennae not connected to receivers are more difficult to align for optimum performance.

The present invention integrates multiple antennae as a single rigid assembly guaranteeing alignment between these antennae and providing higher isolation with lower insertion loss than single antenna duplexing methods can achieve.

BRIEF SUMMARY OF THE INVENTION

One embodiment of the invention provides a rigid body shaped to provide separate dish antennae (i.e., dish reflectors) for collimated parallel microwave beams; with focal points at either end of the rigid body.

Very little signal leaks between these antennae; enabling them to be used simultaneously for receiving and transmitting. Even for time division duplexing applications, elimination of the switched attenuators gives the present invention the advantages of higher isolation and lower signal losses compared with current techniques.

DETAILED DESCRIPTION OF THE INVENTION

A single antenna is often used in a duplex communication system because it naturally aligns the received and transmitted beams. But the design effort, compromised specifications, and component cost to separate these signals can eclipse the antenna they serve.

Any portion of a dish reflector works to focus a collimated beam parallel to that original dish's axis. Although segmented antennae have been used to reduce the size of antenna arrays, the foci in these designs usually cluster in front of the center of the antenna.

Figure 1:
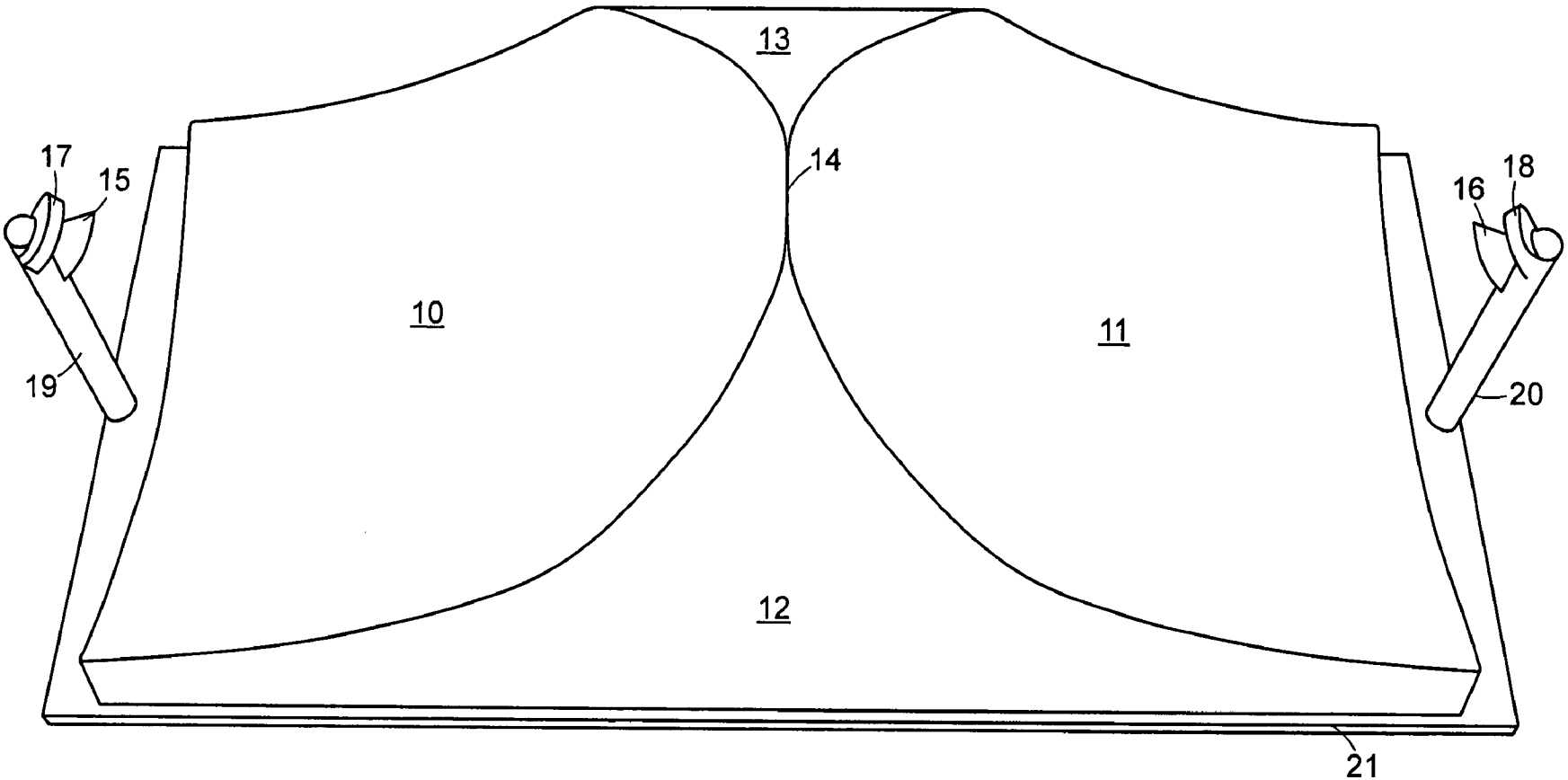
FIG. 1 shows an antenna assembly constructed according to the invention without a radome attached.

By increasing the distance, and hence the isolation, between the foci, the present invention combines partial dishes, 10 and 11 in FIG. 1, to abut on their rims, 14, spacing apart their foci (and feedhorns 15 and 16) the full length of the assembly.

In the preferred embodiment formed from a single piece of metal, the variety of angles and curves in this configuration serve to stiffen the assembly, guaranteeing the alignment of the reflectors.

In the preferred embodiment a metal plate, 21, fastened to the back of the assembly confers more rigidity; and creates a Faraday cage suitable for housing electronic circuitry. With its large surface area, such a housing can dissipate heat well.

In the preferred embodiment, the curvature of the reflector is chosen so that its rim, 14, obstructs the line between the foci located in the feedhorns 15 and 16. Additional isolation can be achieved with the addition of a reflective plate in the plane at 14 which bisects the line between the foci.

In the preferred embodiment, an exponential horn (15 and 16) with circular cross section and an exit angle of 90 degrees and phase center at the focus illuminates the parabolic reflector (10 and 11). The projected disk fills most of the reflector. Thus, for example, the unit shown in FIG. 1 can generate a transmitted beam and receive a separate beam in the following manner: feedhorn 15 transmits a beam to dish 10, and dish 10 reflects that beam thus forming the transmitted beam; and dish 11 reflects a separate received beam towards feedhorn 16. Electronics generate a signal that causes feedhorn 15 to transmit its beam towards dish 10, and also processes the beam received by feedhorn 16. Similarly, the two dishes 10, 11 can be used to transmit two independent beams (in which case the dishes 10, 11 reflect separate beams received from the feedhorns 15, 16), or to receive two independent beams (in which case the dishes 10, 11 reflect separate received beams towards feedhorns 15, 16).

Not needing a diplexer or transmit-receive switch, the feedhorns (15 and 16) can interface directly to the transmitter and receiver electronics at 17 and 18 respectively, avoiding switch and diplexer losses. If the electronics at 17 and 18 do frequency conversions, then lower frequency signals (as opposed to microwaves) can be routed through coaxial cables in the posts 19 and 20 to connectors or to electronic circuitry within the assembly. This can significantly reduce costs compared with routing microwave signals through waveguides.

Figure 2:
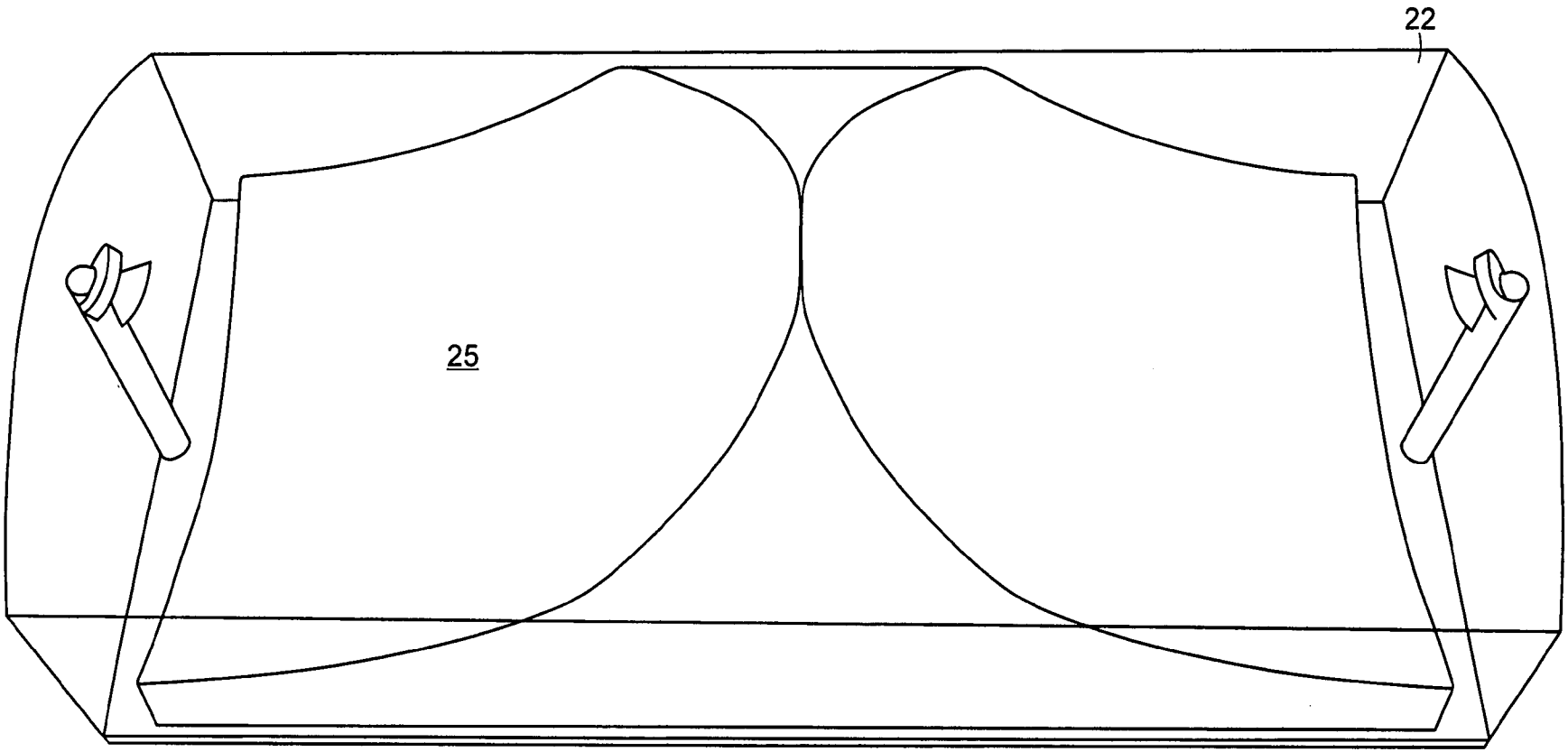
FIG. 2 shows an antenna assembly constructed according to the invention with a transparent radome attached.

Rather than extend the parabolic reflectors (10 and 11) to areas where they are not illuminated by the feedhorns (15 and 16), the preferred embodiment truncates those surfaces at areas 12 and 13. Although the flat top areas, 29, shown in FIG. 5 would suffice, the preferred embodiment shown in FIGS. 1 and 2 truncates to an inverted parabolic cylinder to limit the depth of drawing if the antenna assembly is to be formed by stamping or casting.

A radome in the shape of the cylinder just described can be fitted to the assembly to shield it from the effects of weather. In the preferred embodiment, the rims at 14 are higher than the feedhorns 15 and 16 and their electronics 17 and 18. Hence the radome, 22 in FIG. 2, encloses the assembly, 25.

Figure 3:
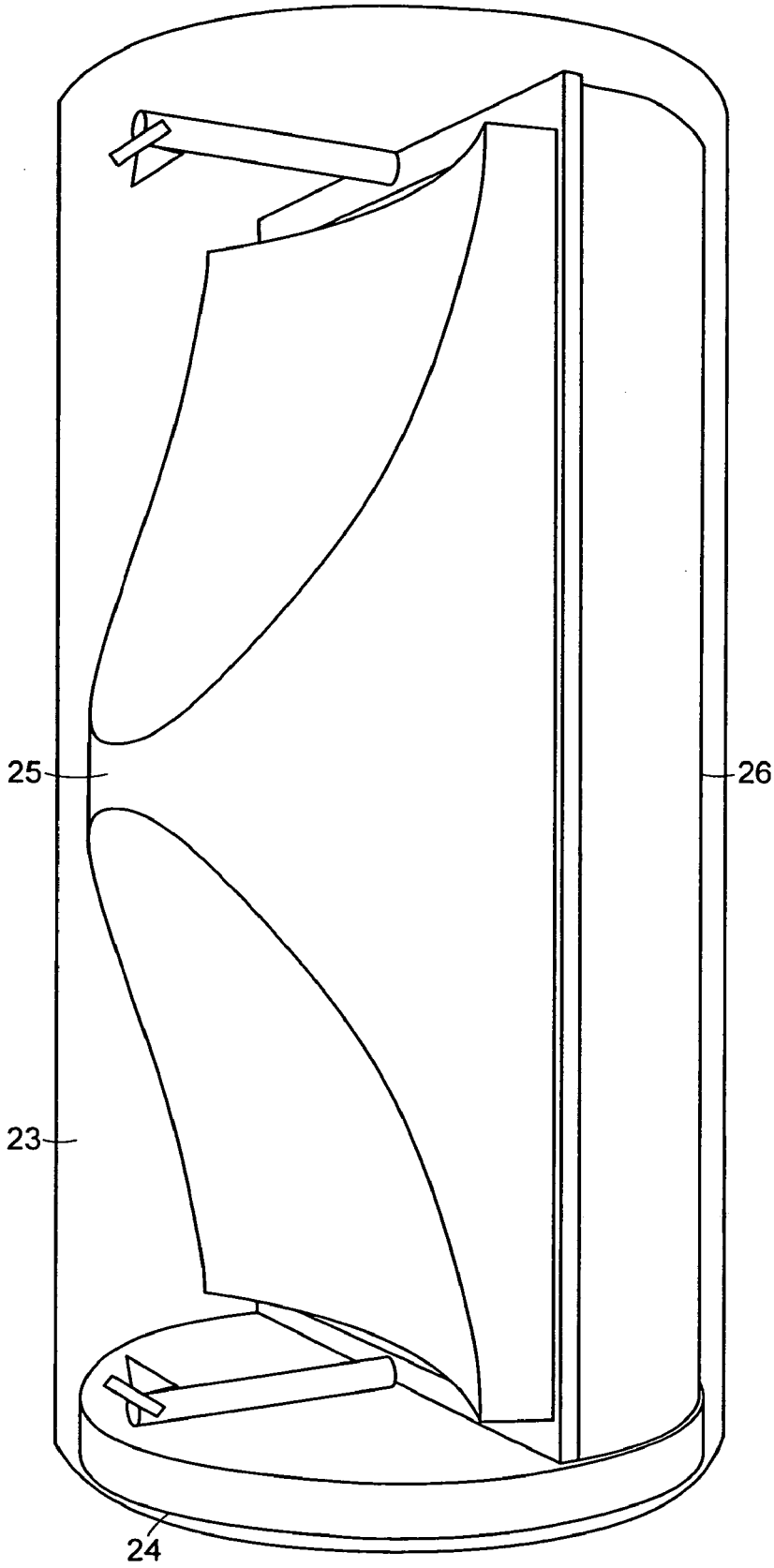
FIG. 3 shows an antenna assembly constructed according to the invention with a half-cylinder back attached, a circular base for rotation, and covered by a cylindrical radome.
Figure 4:
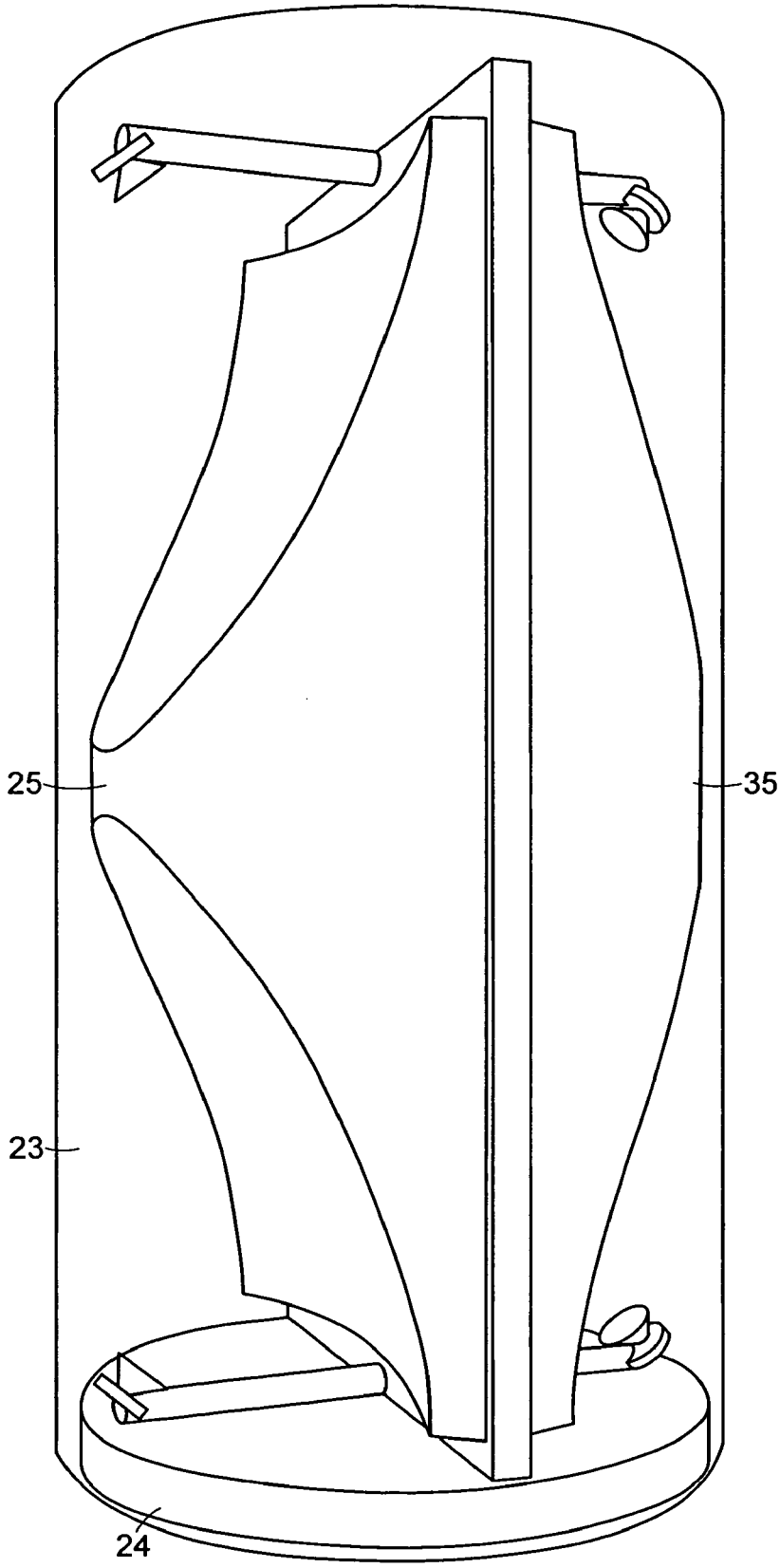
FIG. 4 shows two duplex antenna assemblies mounted back to back in accordance with the invention, a circular base for rotation, and covered by a cylindrical radome.

The radar embodiments shown in FIGS. 3 and 4 truncate to a right cylinder with circular cross section.

Radar

Active remote sensing, such as weather radar, is a focused, duplex application for the present invention. FIG. 3 shows the antenna assembly, 25, standing upright on a rotary bearing, 24, with a half-cylinder back, 26. The envelope of the assembly fitting within a cylinder allows it to rotate while covered by a cylindrical radome, 23.

FIG. 4 shows two antenna assemblies, 25 and 35, mounted back to back and standing on a rotary bearing, 24, for use in a radar system. Multiple frequency bands could be scanned by the device. If one antenna assembly, 25, is inclined relative to the other, 35, then two cones of sky can be scanned by the device. As above, the envelope of the assembly fitting within a cylinder allows it to rotate while covered by a cylindrical radome, 23.

Minimal Area

Figure 7:
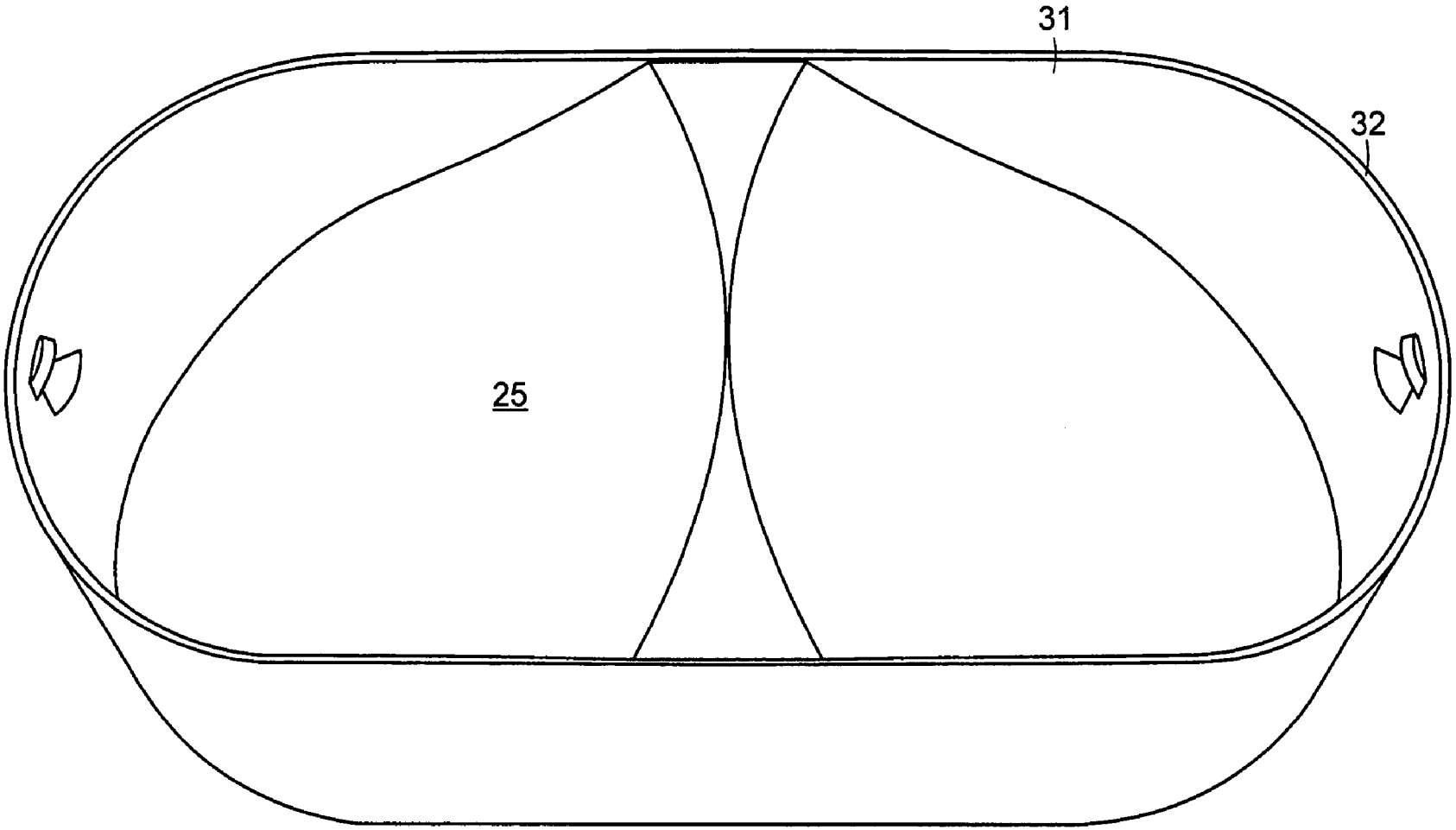
FIG. 7 shows the antenna with rounded corners and flat radome.

Rent on antenna towers being proportional to an antenna's silhouette area, FIG. 7 shows a duplex antenna, 25, with its four corners rounded to reduce its area. The unit shown in FIG. 7 is formed from two sheets of metal that are fixed together. A first sheet is stamped to form the two dishes, and a second sheet 31 is stamped to form an enclosure. The enclosure defines upright walls that surround the dishes as well as a flat base, or backplate. The feedhorns are mounted on the enclosure (e.g., instead of on posts). The unit can be covered with a flat radome, 32, sealing the duplex antenna unit.

The units shown in FIGS. 1 and 7 each include a flat base (e.g., shown in FIG. 1 at flat metal plate 21). The flat base advantageously simplifies mounting the antenna unit on a tower. Prior art dish antennas are generally mounted at the dish's center to the tower, which disadvantageously produces only a small area of contact between the dish and the tower and also allows wind to stress the antenna mounting. In contrast to the prior art, the flat base provided by antenna units constructed according to the invention significantly increases the area of contact between the antenna unit and the tower.

High Capacity

Figure 5:
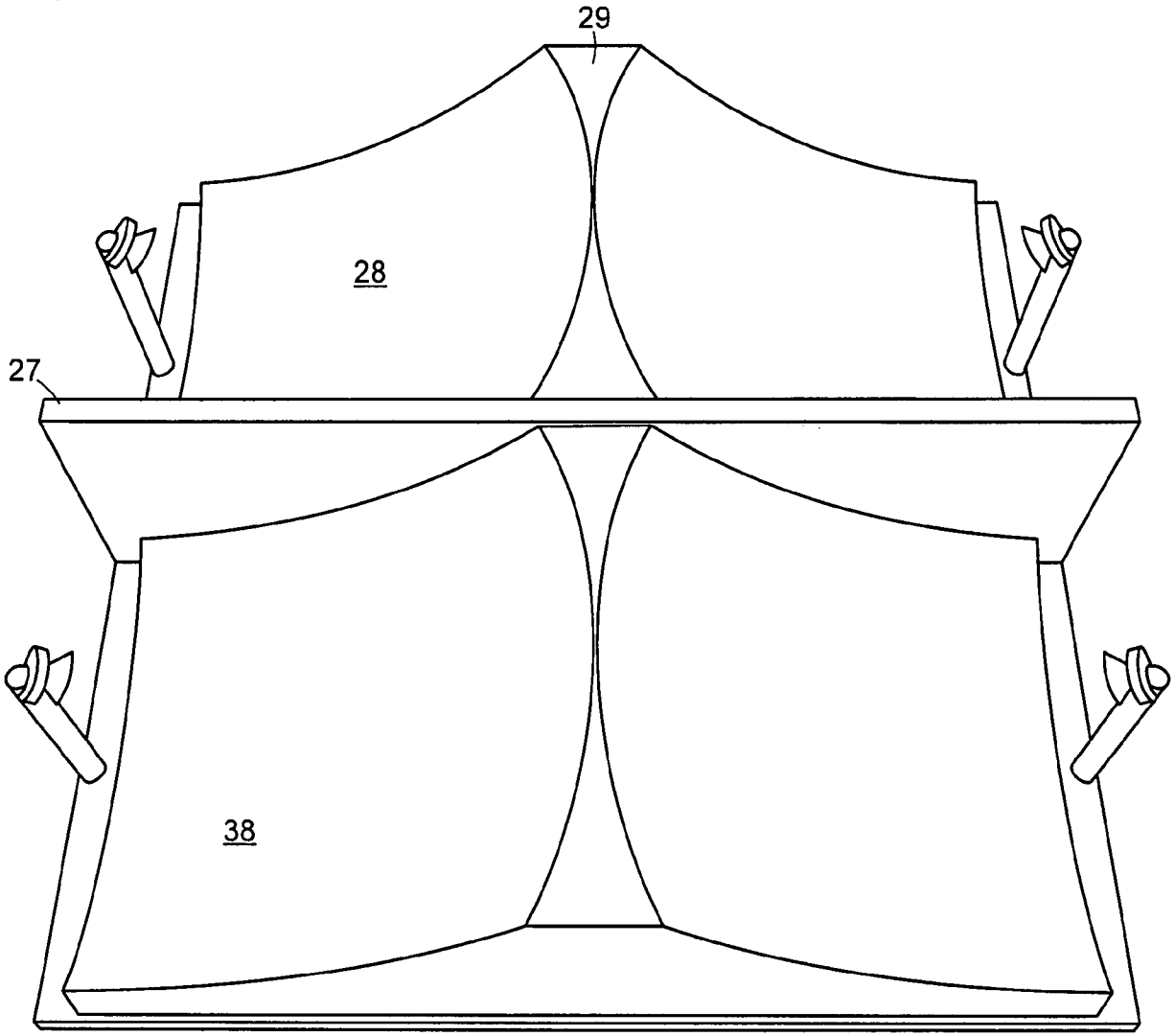
FIG. 5 shows duplex antenna assemblies ganged in accordance with the invention to increase channel capacity.

High capacity backhauling applications may require operating transmitters and receivers in multiple frequency bands. Where the expense or signal losses of diplexers are unacceptable, duplex antennae can be ganged as shown in FIG. 5. High isolation can be achieved by putting reflective baffles, 27, between adjacent duplex units, 28 and 38. High isolation is usually necessary only between transmit and receive feedhorns. Thoughtful organization, such as putting all the transmitters on one side and all the receivers on the other, can eliminate most need for baffles.

Figure 8:
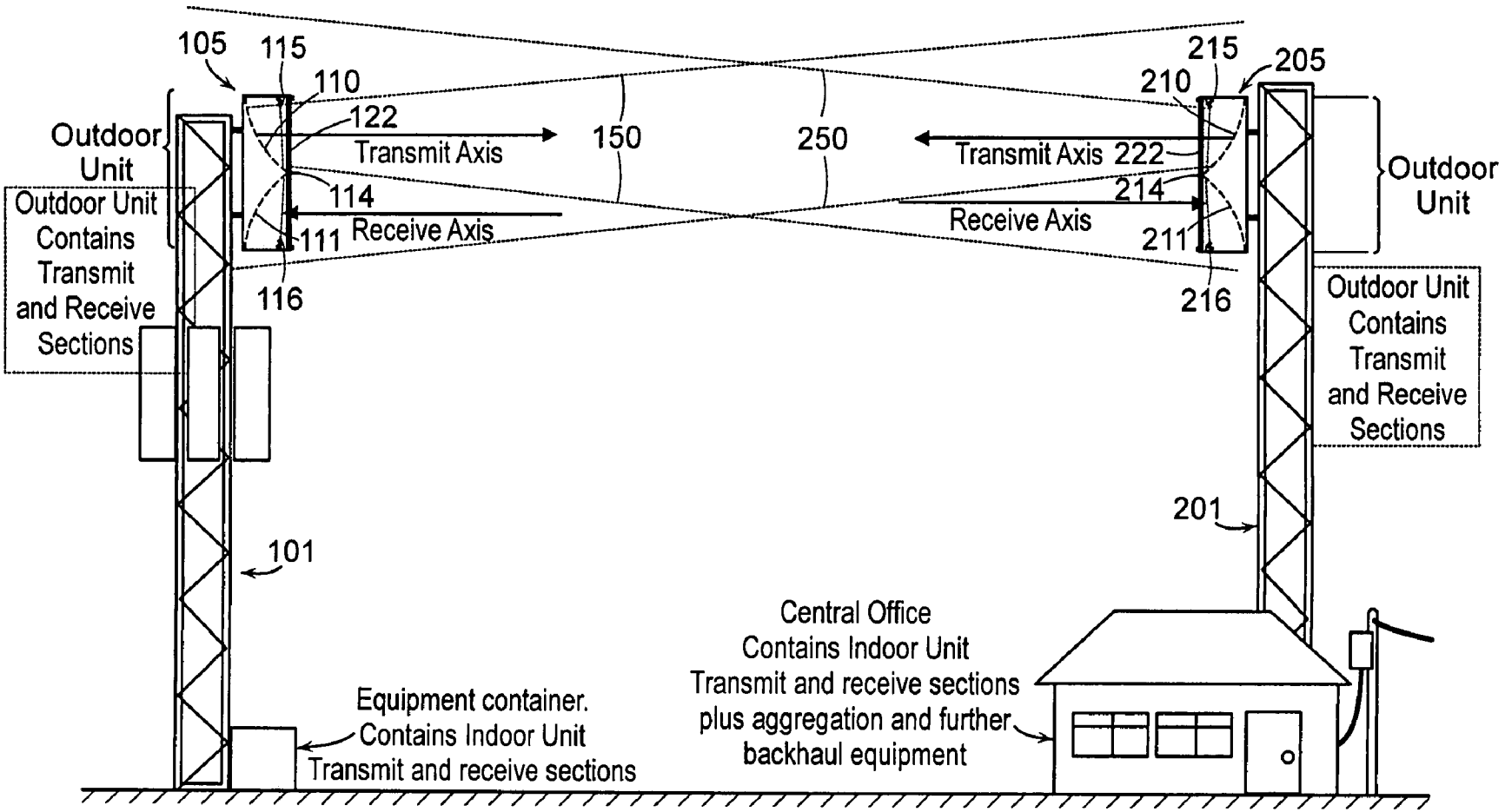
FIG. 8 shows how two separate antenna units constructed according to the invention may be used in a cell phone backhauling application.

FIG. 8 shows an example of how two antenna units 105, 205 constructed according to the invention may be used in a cellular telephone backhauling application. Each of antenna units 105, 205 is similar to the units shown in FIGS. 1 and 2. Specifically, unit 105 defines two partial dish reflectors 110, 111 separated by a rim 114. A feedhorn 115 is disposed such that the focus of dish 110 is within feedhorn 115, and a feedhorn 116 is disposed such that the focus of dish 111 is located within feedhorn 116 (the focus of each dish may preferably be located within, or just behind, the dish's associated feedhorn at the point at which the impedance of the feedhorn matches the impendence of free space). Unit 105 is enclosed within a protective radome 122. Similarly, unit 205 defines two partial dish reflectors 210, 211 separated by a rim 214. A feedhorn 215 is disposed such that the focus of dish 210 is located within feedhorn 215, and a feedhorn 216 is disposed such that the focus of dish 211 is located within feedhorn 216. Unit 205 is enclosed within a protective radome 222. Unit 105 is mounted on a cell tower 101, whereas unit 205 is mounted on a tower at a telephone central office 201.

In unit 105, reflector 110 is used to generate a transmitted beam 150. In unit 205, reflector 210 is used to generate a transmitted beam 250. In unit 105, reflector 111 is used to receive the beam 250 (generated by unit 205). In unit 205, reflector 211 is used to receive the beam 150 (generated by unit 105).

In operation, the cell tower 101 and the central office 201 communicate (via antenna units 105, 205) to enable cell phone use. At any given time, cell tower 101 is in communication with a plurality of cell phones. Radio equipment located in the equipment container (or "hut") under tower 101 collects information transmitted by that plurality of cell phones and transmits it to central office 201 via transmitted beam 150. Similarly, information to be transmitted to the plurality of cell phones is transmitted from radio equipment in the central office 201 to tower 101 via beam 250. Equipment in the hut of tower 101 uses the information contained in beam 250 to generate the signal that it broadcasts to the plurality of cell phones.

In one type of prior art backhauling application, the cell tower included a single dish antenna that was used (a) to generate a beam that was transmitted to the central office and (b) to receive a beam that was transmitted from the central office (similarly, the central office included a single dish antenna that was used to (a) generate a beam that was transmitted to the cell tower and (b) to receive a beam that was transmitted from the cell tower). Such systems suffered because they had to use a single dish antenna for both transmitted and received beams. Such systems used either time division or frequency division multiplexing. In such time division multiplexing systems, only one location (e.g., the central office or the cell tower) can transmit at a time limiting aggregate capacity. Also, such frequency division multiplexing systems use larger bandwidth and are therefore inherently more expensive.

In another type of prior art backhauling application, the cell tower included two separate dish antennae (one for transmit and one for receive) and the central office also included two separate dish antennae (again, one for transmit and one for receive). Such systems suffered because they required two pairs of antennae to be separately aligned (i.e., (1) cell tower transmit dish and central office receive dish and (2) central office transmit dish and cell tower receive dish).

In contrast to the prior art, in the system shown in FIG. 8, no single dish is used for both transmit and receive, only a single alignment is performed, and neither time division nor frequency division multiplexing is required. Since dishes 110, 111 of unit 105 are formed in a single rigid body, they can be constructed so as to insure that the beams transmitted by dish 110 and received by dish 111 are parallel. Similarly, since dishes 210, 211 of unit 205 are formed in a single rigid body, they can be constructed so as to insure that the beams transmitted by dish 210 and received by dish 211 are parallel. As will be appreciated, the direction of a beam transmitted by a dish (e.g., dish 110) is defined by the axis, or ray, along which the beam has maximum intensity, and similarly, the direction of a beam received by a dish (e.g., dish 111) is defined by the axis, or ray, to which the feedhorn has maximum sensitivity. The transmitted and received beams (e.g., by dishes 110, 111) are parallel if the axes associated with those beams are parallel. The transmit and receive axes for units 105, 205 are illustrated in FIG. 8. Also, the shape of the dishes 110, 111, 210, 211 insure that the beams transmitted or received by them are highly focused.

Since each of units 105, 205 transmit and receive parallel beams, once units 105, 205 are aligned to insure proper reception of one of the beams (e.g., 150), the units 105, 205 will have automatically been aligned to also insure proper reception of the other beam (e.g., 250).

Also, since each of the units 105, 205 provides a high degree of isolation between the two beams 150, 250, these two beams may use the same frequency. Thus, frequency division multiplexing need not be used. Also, since two independent beams 150, 250 are transmitted simultaneously, time division multiplexing is also unnecessary.

The beams 150, 250 in FIG. 8 are shown as diverging beams. It will be appreciated that the angle of divergence shown in FIG. 8 is greater than the actual angle of divergence for beams transmitted by units 105, 205. However, the beam transmitted by unit 105 will generally have diverged enough by the time it reaches unit 205 so as to completely encompass unit 205 (as shown generally in FIG. 8). Similarly, the beam transmitted by unit 205 will generally have diverged enough by the time it reaches unit 105 so as to completely encompass unit 105 (as shown generally in FIG. 8). The amount of divergence experienced by the beam by the time the beam reaches the next antenna unit is of course a function of the distance between the two units 105, 205. The maximum distance achievable between units 105, 205 is a function of several parameters such as dish size, transmit power, and frequency. About one to three kilometers is a typical distance between units 105, 205.

It also will be appreciated that use of units 105, 205 also simplifies radio equipment connected to the antenna units. Such radio equipment generally includes (a) an "indoor unit", which is located inside a building, such as the cell tower hut, and is therefore shielded from the outside environment, and (b) an "outdoor unit", which is located very near the feedhorn and is therefore at least partly exposed to the outside environment. As an example of the simplification provided by the invention, prior art outdoor units designed for use with time division multiplexing schemes included a receiver protect switch that isolated the outdoor unit's receive circuitry when the outdoor unit's transmitter was operating. Similarly, such prior art outdoor units also included a transmit power switch which connected the outdoor unit's transmitter to the antenna during only defined transmit time intervals. Outdoor unit's designed for use with antenna units constructed according to the invention need neither the receiver protect switch nor the transmit power switch (i.e., since the radio's transmitter is continuously coupled to a transmit dish, such as dish 110, and since the radio's receiver is continuously coupled to a receive dish, such as dish 111). Also, since the transmitter portion of such an outdoor unit couples (via a feedhorn) to one dish and the receiver portion of such an outdoor unit couples (via another feedhorn) to a different dish, such outdoor units constructed in accordance with the invention can simultaneously transmit and receive at the same frequency.

Figure 9:
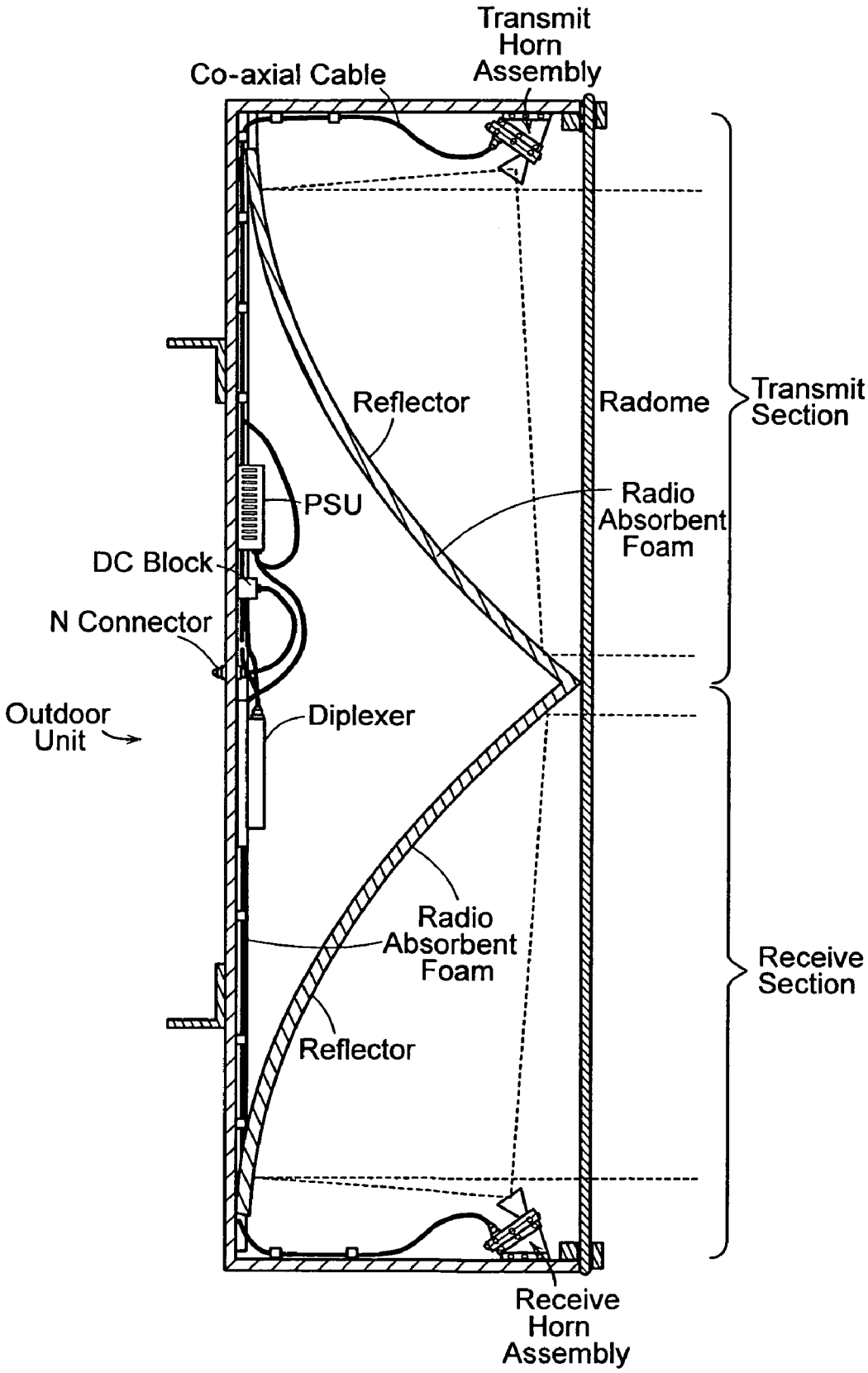
FIG. 9 shows a sectional side view of the antenna unit shown in FIG. 7.

FIG. 9 shows a sectional side view of the antenna unit shown in FIG. 7. As shown, the outdoor unit, which communicates with the feedhorns, can be located in interior space between the enclosure and the reflectors. It may be advantageous to coat interior surfaces with radio frequency absorbent foam, while preferably the exterior surfaces of the dishes are left bare. When mounting the antenna unit (e.g., on a tower), it may also be advantageous to orient the unit so that the dish used for transmit is above the dish used for receive.

Table 1 below shows physical dimensions for three example embodiments of antenna units constructed according to the invention (such as the ones shown in FIGS. 1, 7, and 9). The "Bounds" and "Area" are the length and width, and area, respectively, of a unit that includes two dishes (such as dishes 10, 11 of FIG. 1). The "Area/Dish" is the area of a single dish (e.g., 10 of FIG. 1) of the unit. The table shows the gain and beam width (or beam angle) associated with each of the three example embodiments for five different operating frequencies. It will be appreciated that each dish (e.g., dish 10 of FIG. 1) is an offset antenna. As is well known in the art of offset antennas, the surface of the dish ideally tracks a theoretical surface that is defined by rotating a parabola about an axis of rotation. The parabola of the dish is also ideally matched to the curvature of the feedhorn. The axis of rotation extends from the focal point to the point on the theoretical surface that is closest to the focal point. Again, as is well known in the art of offset antennas, the actual dish only covers part of that theoretical surface. The portions of the theoretical surface that are omitted from the dish are selected so as to offset the transmit (or receive) axis from the axis of rotation (so as to prevent the feedhorn from obstructing the beam) and to maximize the amount of beam energy that can be transmitted between the feedhorn and dish. In antenna units constructed according to the invention, the focal length of the parabola (which defines the ideal location of the feedhorn) is preferably selected so that the rims of the dishes obstruct a straight line between the two feedhorns (e.g., as shown in FIG. 1, the rim 14 obstructs a straight line between feedhorns 15, 16).

TABLE 1

| | Bounds | | | | | |
|---|---|---|---|---|---|---|
| | 64. cm * 32. cm | | 96. cm * 48. cm | | 127. cm * 64. cm | |
| | Area | | | | | |
| | 1810. $cm^2$ | | 4072. $cm^2$ | | 7238. $cm^2$ | |
| | Area/Dish | | | | | |
| | 796. $cm^2$ | | 1791. $cm^2$ | | 3184. $cm^2$ | |
| | Gain | Beam Width | Gain | Beam Width | Gain | Beam Width |
| 15. GHz: | 32.7 decibels | 3.60 degrees | 36.3 decibels | 2.40 degrees | 38.8 decibels | 1.80 degrees |
| 18. GHz: | 34.3 decibels | 3.00 degrees | 37.8 decibels | 2.00 degrees | 40.3 decibels | 1.50 degrees |
| 23. GHz: | 36.5 decibels | 2.36 degrees | 40.0 decibels | 1.56 degrees | 42.5 decibels | 1.17 degrees |
| 26. GHz: | 37.5 decibels | 2.08 degrees | 41.0 decibels | 1.38 degrees | 43.5 decibels | 1.04 degrees |
| 38. GHz: | 40.8 decibels | 1.42 degrees | 44.3 decibels | .095 degrees | 46.8 decibels | 0.71 degrees |

Figure 10:
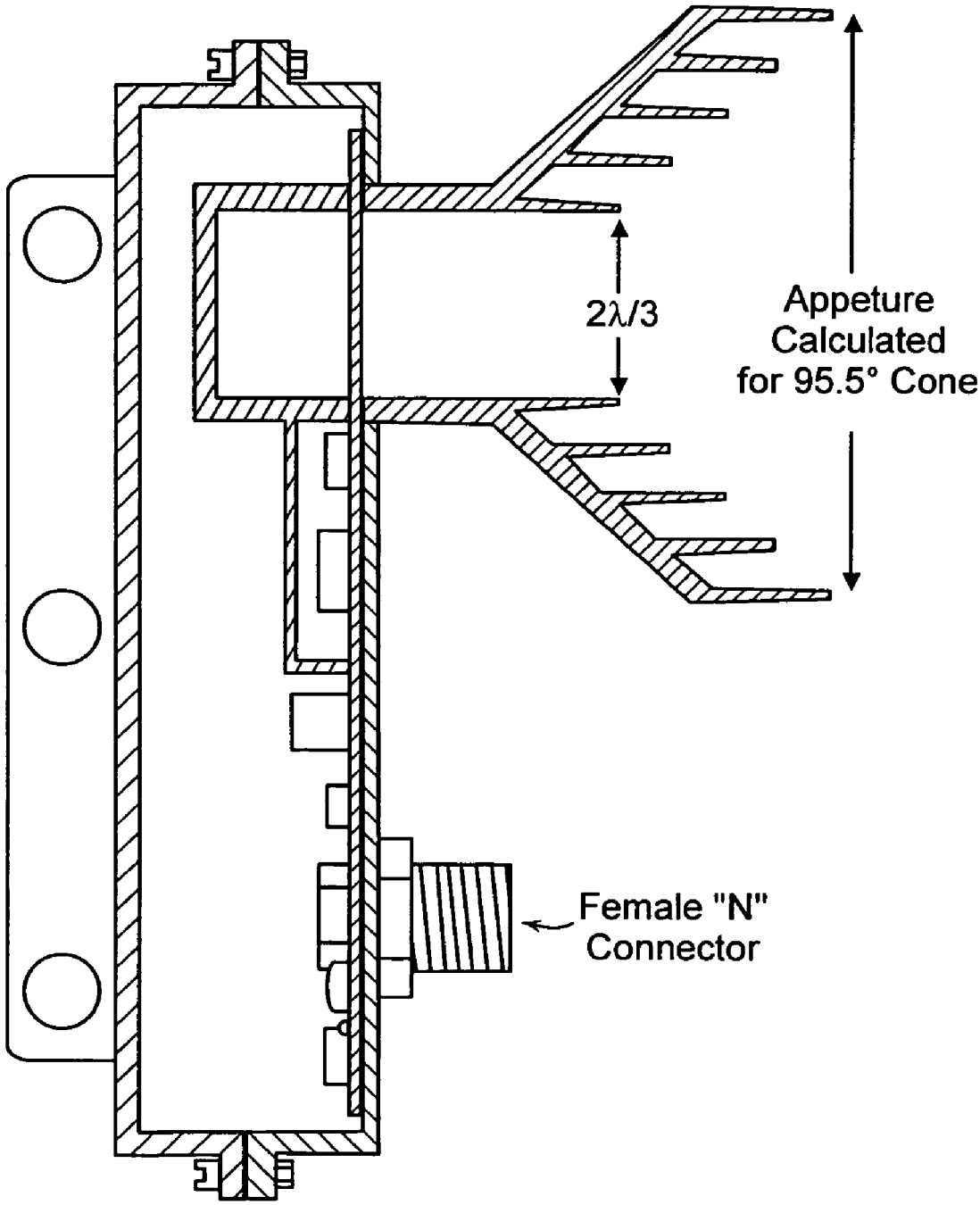
FIG. 10 shows a sectional side view of a feedhorn assembly that may be used with antenna units constructed according to the invention.
Figure 11:
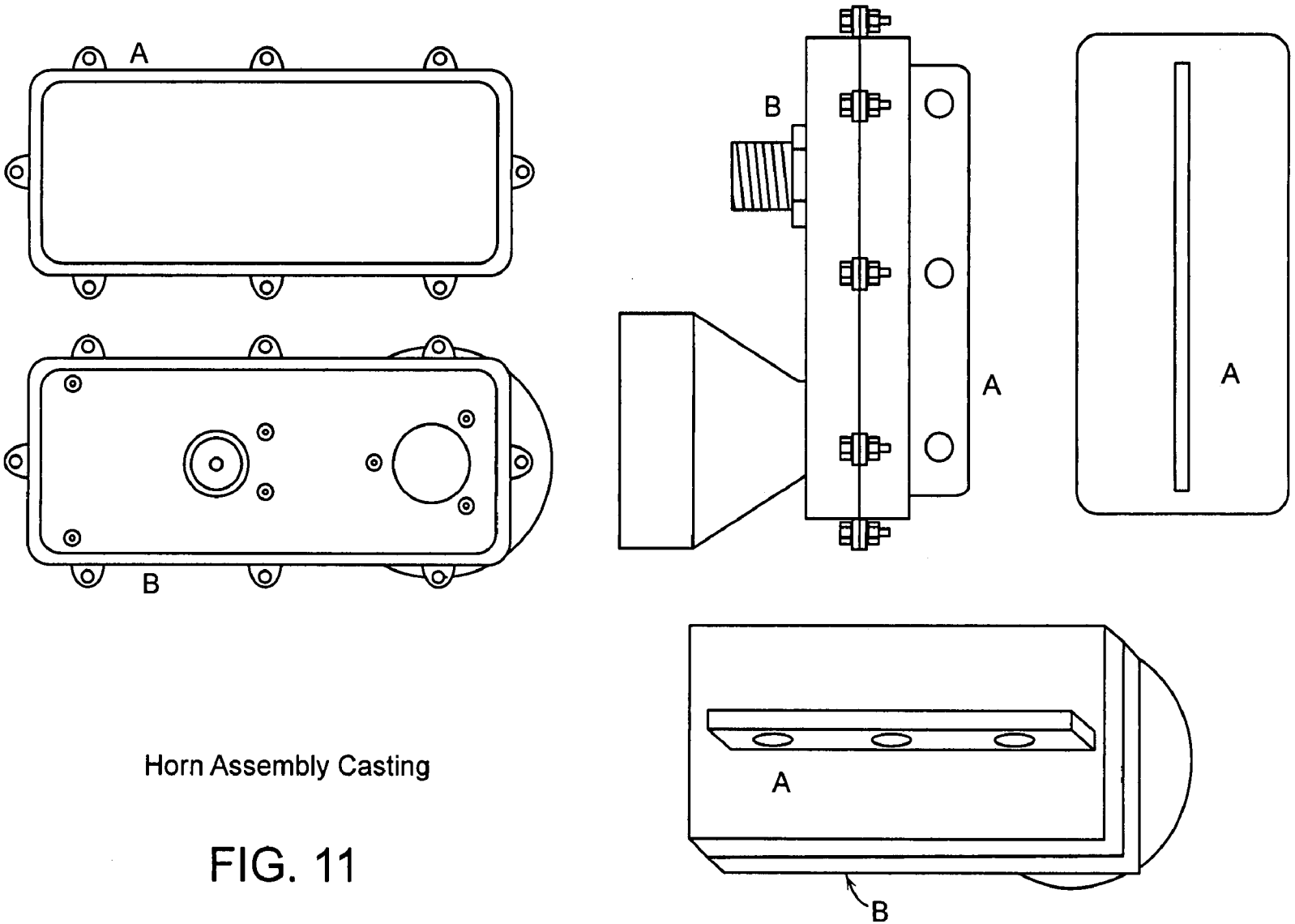
FIG. 11 shows a disassembled view of the components used to construct the feedhorn assembly shown in FIG. 10.

FIG. 10 shows a cross section of an example feedhorn assembly that can be used with the invention. FIG. 11 shows how the feedhorn assembly shown in FIG. 10 may be constructed from two cast aluminum components, A, B.

Another advantage of the present invention is that the feedhorns need not be disposed in the center of the dish as is typically done in the prior art. The location of the feedhorns shown e.g., in FIG. 1 prevents them from obstructing the beams transmitted and received by the dishes of the unit.

Polarization

Figure 6:
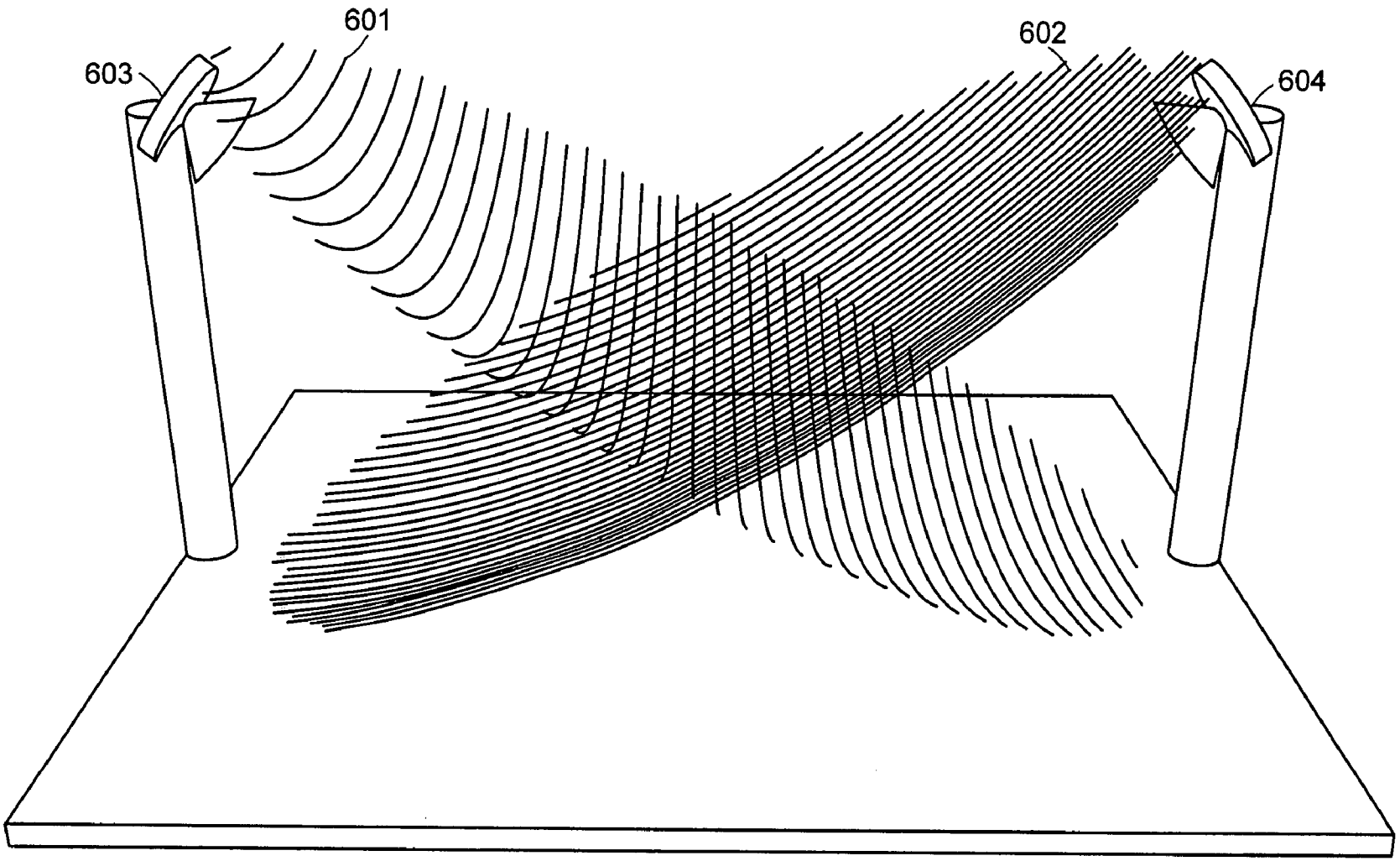
FIG. 6 shows a compact dual polarization antenna assembly constructed according to the invention.
Figure 6A:
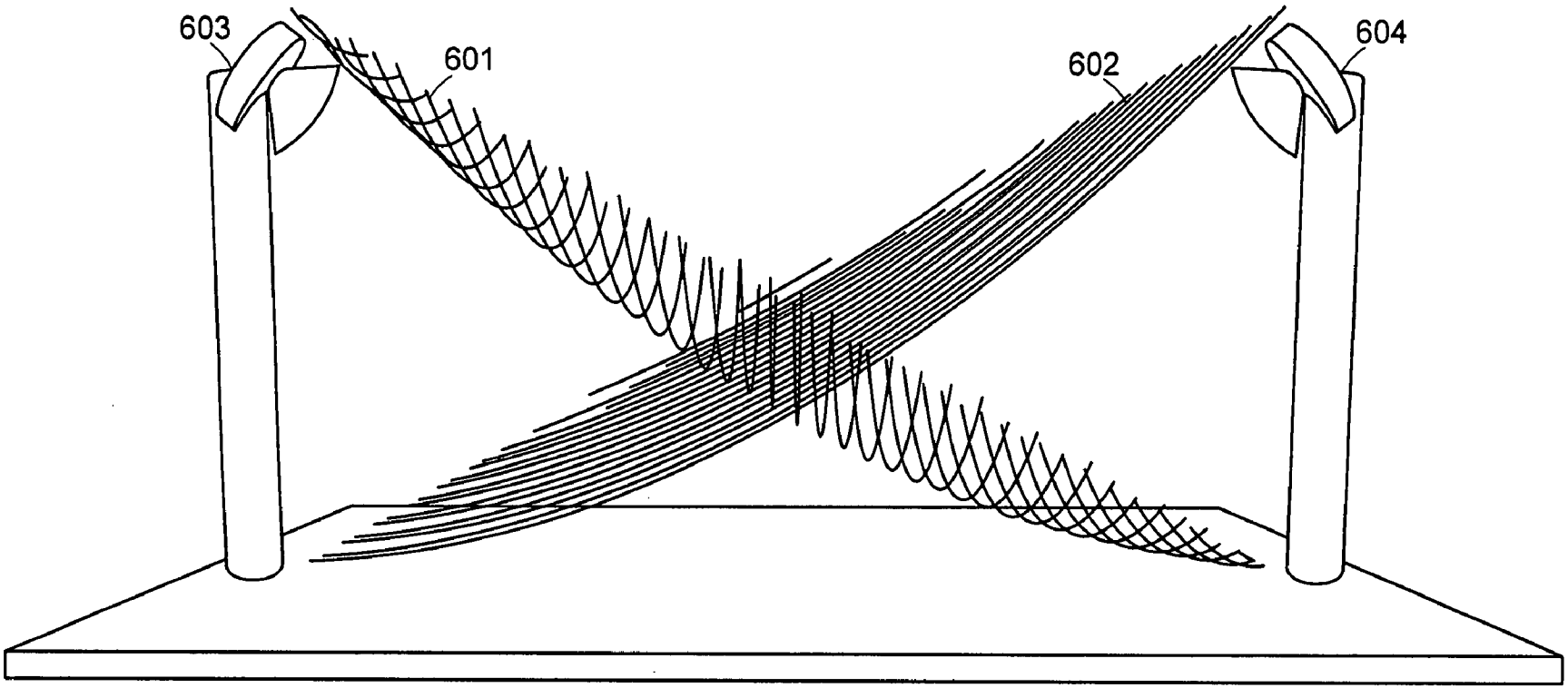
FIG. 6A shows a sectional side view of the antenna unit shown in FIG. 6.

Perpendicular polarizations permit overlapped dual antennae which are more compact yet have large separation between the foci. In FIG. 6, one parabolic dish reflector 601 is formed from rigid wires running along the length of the base; and another parabolic dish reflector 602 is formed from rigid wires running along the width of the base. Each dish 601, 602 reflects a beam having a polarization that is orthogonal to the polarization of the beam reflected by the other dish. The supports for the wires are not shown, but both dishes 601, 602 are integrated into a single rigid body. The simplest way to integrate each wire into the rigid body is to bend each wire at the perimeter of the dish shape such that each wire includes two downwardly extending ends (not shown) and by attaching both (downwardly extending) ends of each wire (e.g., by welding or adhesives) to the flat base. A feedhorn 603 is located at the focal point of dish 601, and a feedhorn 604 is located at the focal point of dish 602. FIG. 6A shows a side view of the unit shown in FIG. 6. As shown in FIG. 6A, the two dishes 601, 602 intersect and overlap with one another thus reducing the spacing between the two feedhorns 603, 604. Although spacing between feedhorns 603, 604 is reduced (e.g., as compared with the feedhorns shown in FIG. 1), feedhorn 603 is outside of the conical beam reflected by dish 602, and similarly feedhorn 604 is outside of the conical beam reflected by dish 601.

It will be appreciated that the arrangement shown in FIGS. 6 and 6A allows a doubling of the data to be transmitted or received by a dish of any given size. That is, a dish of diameter D is generally used to transmit or receive a single beam. However, in the arrangement shown in FIGS. 6 and 6A, the distance between the feedhorns is only slightly larger than D, and yet the arrangement can be used to handle two independent beams. That is, the arrangement shown in FIGS. 6 and 6A can (a) transmit two independent beams; (b) receive two independent beams; or (c) transmit one beam and receive a beam that is independent from the transmitted beam.

Figure 6B:
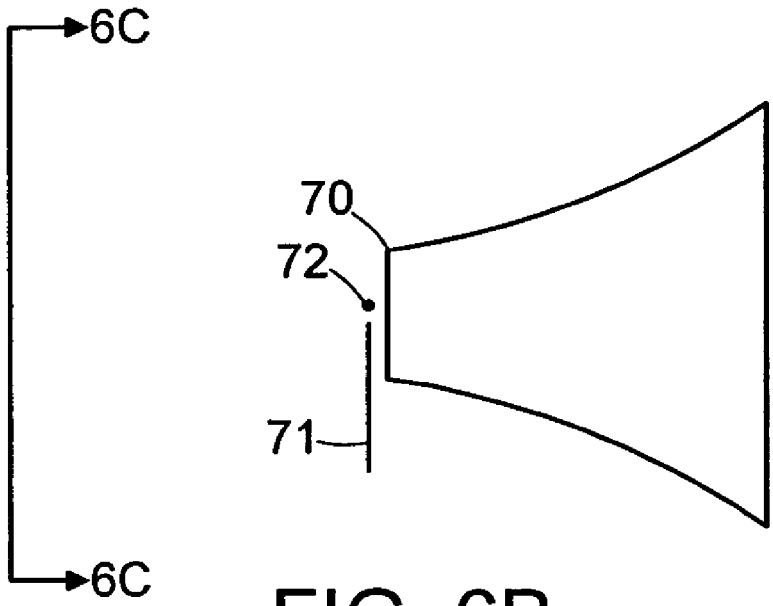
FIG. 6B shows a side view of a feedhorn and the location of two signal launchers with respect to the feedhorn.
Figure 6C:
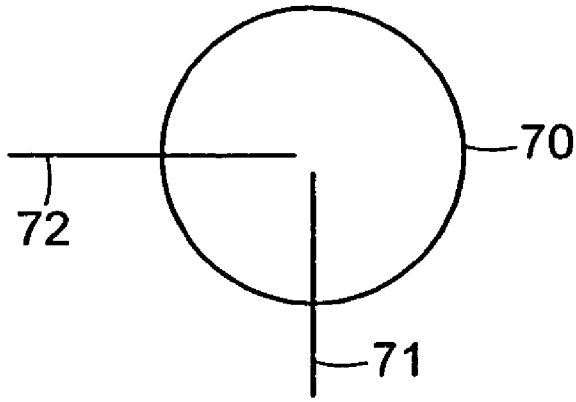
FIG. 6C shows a view of the feedhorn shown in FIG. 6B taken in the direction of the arrows 6C-6C shown in FIG. 6B.

With reference to FIG. 1, another way to advantageously use polarization is to provide two signal launchers in feedhorn 15 and two signal receivers in the other feedhorn 16. The two signal launchers are configured so as to produce beams aimed at dish 10 with orthogonal polarizations, and similarly, the two signal receivers are configured so as to receive beams with orthogonal polarizations from dish 11. FIGS. 6B and 6C show an example of how the signal launchers (or the signal receivers) can be configured. As shown, two wires 71, 72, are disposed orthogonally to one another behind the rear opening 70 of the feedhorn. It will be understood that each of these wires is connected to circuitry in outdoor unit, and that each of these wires can function as a signal launcher (to generate a signal that is transmitted from the feedhorn to the dish) or as a signal receiver (to receive a signal from the dish). It will be appreciated that equipping feedhorn 15 with two signal launchers and feedhorn 16 with two signal receivers allows the data transmitted and received by the unit shown in FIG. 1 to be doubled (i.e., since each dish either transmits or receives two independent beams at orthogonal polarization angles).

Applications

Reducing the cost of customer-premises equipment is a requirement for providing television services to consumers using the Local Multipoint Distribution Service (LMDS) bands. Provisional Patent Application U.S. 60/637,654, "High Definition Television Distribution over Wireless Metropolitan Area Networks", filed Dec. 20, 2004 by Jaffer, et al describes such a point-to-multipoint (PMP) system which would benefit from the cost reductions resulting from use of the present invention.

The present invention can reduce the cost of fixed wireless duplex point-to-point (PTP) links. PMP and PTP applications include broadband Internet connections, mobile cellular infrastructure, cellular telephone backhaul, CATV backhaul, CATV and carrier last-mile access, fixed network connections, private network connections, disaster recovery, and public transportation and utility connections.

Other changes, embodiments or substitutions made by one skilled in the art according to the present invention is considered within the scope of the present invention which is not to be limited by the claims which follow.

What we claim as our invention is:

1. An antenna unit, comprising:

a substantially rigid metallic body, the body defining a first curved surface and a second curved surface, the first curved surface defining a first focal point, the second curved surface defining a second focal point, the first curved surface defining a first axis along which the first curved surface can transmit a first electromagnetic beam, the second curved surface defining a second axis along which the second curved surface can receive a second electromagnetic beam, the first axis and the second axis being substantially parallel, the first focal point and the second focal point being separated by a separation distance, the separation distance being greater than a distance between the first focal point and any point on the first curved surface;

a first feedhorn disposed proximal to the first focal point; and a second feedhorn disposed proximal to the second focal point.

2. An antenna unit according to claim 1, the unit including a first piece of metal, the first piece of metal defining the first and second curved surfaces.

3. An antenna unit according to claim 2, the unit including a second piece of metal, the second piece being substantially rigidly attached to the first piece.

4. An antenna unit according to claim 3, the second piece forming a substantially flat backplate.

5. An antenna unit according to claim 3, the first and second feedhorns being attached to the second piece of metal.

6. An antenna unit according to claim 1, further including a first post and a second post, the first feedhorn being attached to the first post, the second feedhorn being attached to the second post.

7. An antenna unit according to claim 1, a straight line connecting the first focal point and the second focal point intersecting at least one of the first and second curved surfaces.

8. An antenna unit according to claim 1, further including a metallic baffle disposed between the first and second focal points.

9. An antenna unit according to claim 1, further including a radome, the radome enclosing the body, the first feedhorn, and the second feedhorn.

10. An antenna unit according to claim 1, the first feedhorn including a first signal launcher and a second signal launcher, the first and second signal launchers being configured to transmit electromagnetic beams characterized by orthogonal polarizations.

11. An antenna unit according to claim 1, the second feedhorn including a first signal receiver and a second signal receiver, the first and second signal receivers being configured to receive electromagnetic beams characterized by orthogonal polarizations.

12. An antenna unit according to claim 1, the first focal point being disposed within the first feedhorn, the second focal point being disposed within the second feedhorn.

13. A radio communication system, including:

(A) an antenna unit, comprising:

(i) a substantially rigid metallic body, the body defining a first curved surface and a second curved surface, the first curved surface defining a first focal point, the second curved surface defining a second focal point, the first curved surface defining a first axis along which the first curved surface can transmit a first electromagnetic beam, the second curved surface defining a second axis along which the second curved surface can receive a second electromagnetic beam, the first axis and the second axis being substantially parallel, the first focal point and the second focal point being separated by a separation distance, the separation distance being greater than a distance between the first focal point and any point on the first curved surface;

(ii) a first feedhorn disposed proximal to the first focal point; and (iii) a second feedhorn disposed proximal to the second focal point;

(B) a transmitter coupled to the first feedhorn, the transmitter sending a first signal to the first feedhorn, the first feedhorn transmitting in response to the first signal a first feedhorn beam to the first curved surface, the first curved surface transmitting in response to the first feedhorn beam the first electromagnetic beam;

(C) a receiver coupled to the second feedhorn, the second curved surface transmitting in response to the second electromagnetic beam a second feedhorn signal to the second feedhorn, the second feedhorn transmitting in response to the second feedhorn signal a second signal to the receiver, the first and second electromagnetic beams being characterized by substantially the same frequency, the receiver and the transmitter simultaneously receiving the second signal and transmitting the first signal, respectively.

14. A system according to claim 13, the transmitter including an indoor transmitter portion and an outdoor transmitter potion, the receiver including an indoor portion and an outdoor portion, the outdoor portion of the transmitter generating the first signal, the outdoor portion of the receiver receiving the second signal from the second feedhorn.

15. An antenna unit, comprising:

a substantially rigid metallic body, the body defining a first curved surface and a second curved surface, the first curved surface defining a first focal point, the second curved surface defining a second focal point, the first curved surface defining a first axis along which the first curved surface can transmit or receive a first electromagnetic beam, the second curved surface defining a second axis along which the second curved surface can transmit or receive a second electromagnetic beam, the first axis and the second axis being substantially parallel, the first focal point and the second focal point being separated by a separation distance, the separation distance being greater than a distance between the first focal point and any point on the first curved surface;

a first feedhorn disposed proximal to the first focal point; and a second feedhorn disposed proximal to the second focal point.

16. A radio communication system, including:

(A) a first antenna unit, comprising:

(i) a first substantially rigid metallic body, the first body defining a first curved surface and a second curved surface, the first curved surface defining a first focal point, the second curved surface defining a second focal point, the first curved surface defining a first axis along which the first curved surface can transmit a first transmitted electromagnetic beam, the second curved surface defining a second axis along which the second curved surface can receive an electromagnetic beam, the first axis and the second axis being substantially parallel, the first focal point and the second focal point being separated by a first separation distance, the first separation distance being greater than a distance between the first focal point and any point on the first curved surface;

(ii) a first feedhorn disposed proximal to the first focal point; and (iii) a second feedhorn disposed proximal to the second focal point;

(B) a second antenna unit, comprising:

(i) a second substantially rigid metallic body, the second body defining a third curved surface and a fourth curved surface, the third curved surface defining a third focal point, the fourth curved surface defining a fourth focal point, the third curved surface defining a third axis along which the third curved surface can transmit a second transmitted electromagnetic beam, the fourth curved surface defining a fourth axis along which the fourth curved surface can receive an electromagnetic beam, the third axis and the fourth axis being substantially parallel, the third focal point and the fourth focal point being separated by a second separation distance, the second separation distance being greater than a distance between the third focal point and any point on the third curved surface;

(ii) a third feedhorn disposed proximal to the third focal point; and (iii) a fourth feedhorn disposed proximal to the fourth focal point;

the first and second antenna units being separated from one another and aligned such that the first and third axes are substantially parallel, such that the fourth curved surface can receive the first transmitted electromagnetic beam, and such that the second curved surface can receive the second transmitted electromagnetic beam.

17. An antenna unit, comprising:

a first set of wires defining a first dish shaped surface, the first dish shaped surface defining a first focal point and a first axis along which the first set of wires can transmit a first electromagnetic beam, the first electromagnetic beam being characterized by a first polarization;

a second set of wires defining a second dish shaped surface, the second dish shaped surface defining a second focal point and a second axis along which the second set of wires can transmit a second electromagnetic beam, the first axis and the second axis being substantially parallel, the second electromagnetic beam being characterized by a second polarization, the first polarization being substantially orthogonal to the second polarization, the first and second dish shaped surfaces being disposed such that the first focal point is outside of the second electromagnetic beam and such that the second focal point is outside of the first electromagnetic beam;

a first feedhorn disposed proximal to the first focal point; and a second feedhorn disposed proximal to the second focal point.

18. An antenna unit, comprising:

a first set of wires defining a first dish shaped surface, the first dish shaped surface defining a first focal point and a first axis along which the first set of wires can receive a first electromagnetic beam, the first electromagnetic beam being characterized by a first polarization;

a second set of wires defining a second dish shaped surface, the second dish shaped surface defining a second focal point and a second axis along which the second set of wires can receive a second electromagnetic beam, the first axis and the second axis being substantially parallel, the second electromagnetic beam being characterized by a second polarization, the first polarization being substantially orthogonal to the second polarization, the first and second dish shaped surfaces being disposed such that the first focal point is outside of the second electromagnetic beam and such that the second focal point is outside of the first electromagnetic beam;

a first feedhorn disposed proximal to the first focal point; and a second feedhorn disposed proximal to the second focal point.

19. An antenna unit, comprising:

a first set of wires defining a first dish shaped surface, the first dish shaped surface defining a first focal point and a first axis along which the first set of wires can transmit a first electromagnetic beam, the first electromagnetic beam being characterized by a first polarization;

a second set of wires defining a second dish shaped surface, the second dish shaped surface defining a second focal point and a second axis along which the second set of wires can receive a second electromagnetic beam, the first axis and the second axis being substantially parallel, the second electromagnetic beam being characterized by a second polarization, the first polarization being substantially orthogonal to the second polarization, the first and second dish shaped surfaces being disposed such that the first focal point is outside of the second electromagnetic beam and such that the second focal point is outside of the first electromagnetic beam;

a first feedhorn disposed proximal to the first focal point; and a second feedhorn disposed proximal to the second focal point.

20. An antenna unit, comprising:

a first feedhorn;

a second feedhorn; and a substantially rigid metallic body, the body defining a first curved surface and a second curved surface, the first curved surface defining a first focal point, the first focal point being located within the first feedhorn, the second curved surface defining a second focal point, the second focal point being located within the second feedhorn, the first curved surface defining a transmit axis, the second curved surface defining a receive axis, the transmit axis and the receive axis being substantially parallel, the first focal point and the second focal point being separated by a separation distance, the separation distance being greater than a distance between the first focal point and any point on the first curved surface, the first curved surface being configured to reflect a beam received from the first feedhorn and thereby generate a transmitted electromagnetic beam, the second curved surface being configured to reflect a received electromagnetic beam towards the second feedhorn.

* * * * *